US009293857B2

(12) United States Patent
Baer et al.

(10) Patent No.: US 9,293,857 B2
(45) Date of Patent: Mar. 22, 2016

(54) SEALED AND UN-MATED ELECTRICAL CONNECTION SYSTEM USING SINGLE INSERTION PRESS FIT PINS

(71) Applicant: Continental Automotive Systems, Inc., Auburn Hills, MI (US)

(72) Inventors: James D Baer, Gurnee, IL (US); Benjamin C Lin, Palatine, IL (US); Timothy J Trento, Bloomingdale, IL (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 0 days.

(21) Appl. No.: 14/454,789

(22) Filed: Aug. 8, 2014

(65) Prior Publication Data

US 2015/0064962 A1 Mar. 5, 2015

Related U.S. Application Data

(60) Provisional application No. 61/870,853, filed on Aug. 28, 2013.

(51) Int. Cl.

| | |
|---|---|
| ***H01R 13/00*** | (2006.01) |
| ***H01R 13/52*** | (2006.01) |
| ***H01R 12/58*** | (2011.01) |
| *H01R 12/70* | (2011.01) |

(52) U.S. Cl.

CPC ..... *H01R 13/521* (2013.01); *H01R 12/58* (2013.01); *H01R 12/7047* (2013.01)

(58) Field of Classification Search

CPC ..... H01R 23/4006

USPC ..... 439/487, 436, 736

See application file for complete search history.

(56) References Cited

U.S. PATENT DOCUMENTS 7,294,007 B1 * 11/2007 Lawlyes ..... H05K 5/0034 439/276

* cited by examiner

*Primary Examiner* — Phuong Dinh

(57) ABSTRACT

A method of creating a sealed, un-mated electrical connector system using single insertion press-fit pins. Using single insertion press-fit pins allows for use of simple plastic parts for the connector shroud and a true position assurance comb in conjunction with single insertion press-fit pins. The result is a lower cost for the final connector assembly. Less plastic is needed for the combined shroud and true position assurance comb, because the true position assurance is provided in part by the shroud, and in part by the position assurance comb.

21 Claims, 4 Drawing Sheets

SEALED AND UN-MATED ELECTRICAL CONNECTION SYSTEM USING SINGLE INSERTION PRESS FIT PINS

CROSS-REFERENCE TO RELATED APPLICATIONS

This application claims the benefit of U.S. Provisional Application No. 61/870,853 filed Aug. 28, 2013. The disclosure of the above application is incorporated herein by reference.

FIELD OF THE INVENTION

The invention relates generally to a connector having single insertion press-fit pins, where the connector is sealed, even when not connected to a corresponding connector or harness plug.

BACKGROUND OF THE INVENTION

Various types of control units, such as transmission control units (TCU) or engine control units (ECU), which are stand-alone units, have connectors that are used to connect the TCU or ECU to other devices. In systems having a connector which is sealed when not mated to a corresponding electrical connector or harness plug, the pins are required to be sealed when the mating harness plug is not connected. Some designs use a purchased connector from a supplier, and the sealant is dispensed against the plastic connector surface to seal the pins.

With some of these sealed connector designs, the stand-alone unit requires a small aperture in a heat sink or a cover, which is used to avoid a build-up of internal air pressure. A build-up of air pressure may damage the perimeter seal during the assembly process. The small aperture then must be sealed with another component such as a ball bearing or adhesive label.

Traditionally, single insertion press fit pins are only used in unsealed applications, because these types of pins are difficult to seal.

Accordingly, there exists a need for a sealed connector which uses single insertion press-fit pins, where the connector is sealed even when not connected to a corresponding connector or harness plug.

SUMMARY OF THE INVENTION

The present invention is a method of creating a sealed, un-mated electrical connector system using single insertion press-fit pins. By using single insertion press-fit pins, a connector supplier is no longer necessary to create the connector system. This allows for use of simple plastic parts for the connector shroud and a true position assurance comb in conjunction with single insertion press-fit pins. The result is a lower cost for the final connector assembly. Less plastic is needed for the combined shroud and true position assurance comb, because the true position assurance is provided in part by the shroud, and in part by the position assurance comb.

In the present invention, the gaps between the press-fit pins and printed circuit board (PCB) allow for the flow of air through apertures formed as part of the PCB, which provides the proper venting of air, thereby preventing the buildup of internal air pressure during the assembly process. The apertures are then sealed with a sealant, eliminating the need for an additional sealing label. This allows for a true position assurance comb having an anti-scoop rib to be incorporated into the assembly, which is a benefit during manufacturing, such that the anti-scoop rib may be used during a pick and place operation. The insertion force on the pins (as the connector is connected to a corresponding connector) is distributed by the cured sealant, which is bonded to the aluminum heat sink in the pocket. The area of the pins exposed to the sealant is also an area of the pins which does not have the anti-tarnish material used on silver plated pins (the anti-tarnish material inhibits the ability for the sealant to cure).

There are several steps used to assemble the connector of the present invention. A sub-assembly, or housing is created having a plastic shroud, which is attached to an aluminum heat sink, and an outer sealant is dispensed between them. A printed circuit board is then populated with single insertion press-fit pins. A thermally conductive adhesive is then applied to the sub-assembly, and the printed circuit board is connected to the sub-assembly. This creates a pocket for holding a low viscosity sealant. The low viscosity sealant is dispensed in the pocket, and a true position assurance comb is placed over the pins and onto the sealant.

In one embodiment, the present invention is an electrical connector which includes a housing having a cavity, a shroud integrally formed as part of the housing, and a heat sink connected to the housing. A printed circuit board is connected to the heat sink, such that the heat sink is between the printed circuit board and the housing. At least one aperture is formed as part of the printed circuit board, and at least one pin is located in the aperture formed as part of the printed circuit board such that the at least one pin extends into the cavity of the housing. A pocket is formed by a central aperture in the heat sink, at least a portion of the printed circuit board, and part of a thermally conductive adhesive disposed between the printed circuit board and the heat sink. A sealant is located in the pocket such that at least part of the sealant contacts the printed circuit board and the thermally conductive adhesive, and also at least partially surrounds the pin. The sealant at least partially seals the area between the heat sink and the printed circuit board.

At least one recess is formed as part of the housing, at least one rib is formed as part of the heat sink, and the rib is at least partially disposed in the recess when the heat sink is connected to the housing. An outer sealant is disposed in the recess such that the outer sealant at least partially surrounds the rib, and the outer sealant prevents debris from entering the housing. The heat sink may be connected to the housing in different ways. In one embodiment, the outer sealant is cured, and the curing process applied to the outer sealant provides a connection between the heat sink and the housing.

In another embodiment, the electrical connector also includes at least one aperture formed as part of the housing, and at least one aperture is formed as part of the heat sink, such that the aperture formed as part of the heat sink is substantially aligned with the aperture formed as part of the housing. A fastener is inserted through the aperture formed as part of the heat sink and into the aperture formed as part of the housing to connect the heat sink to the housing.

A position assurance comb is disposed in the pocket such that at least a portion of the sealant is disposed between the position assurance comb and the printed circuit board. An anti-scoop rib is formed as part of the position assurance comb, which provides proper alignment of the pin during the connection of the at least one pin to another connector.

As mentioned above, the thermally conductive adhesive is disposed between the printed circuit board and the heat sink, such that the thermally conductive adhesive connects the printed circuit board and the heat sink. A portion of the sealant located in the pocket is in contact with the thermally conductive adhesive, such that the thermally conductive adhesive at least partially contains the sealant in the pocket.

The pin is mounted in the aperture formed as part of the printed circuit board though the use of a press-fit connection, or the like, and at least a portion of the sealant is located in the aperture such that the sealant at least partially surrounds the pin.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
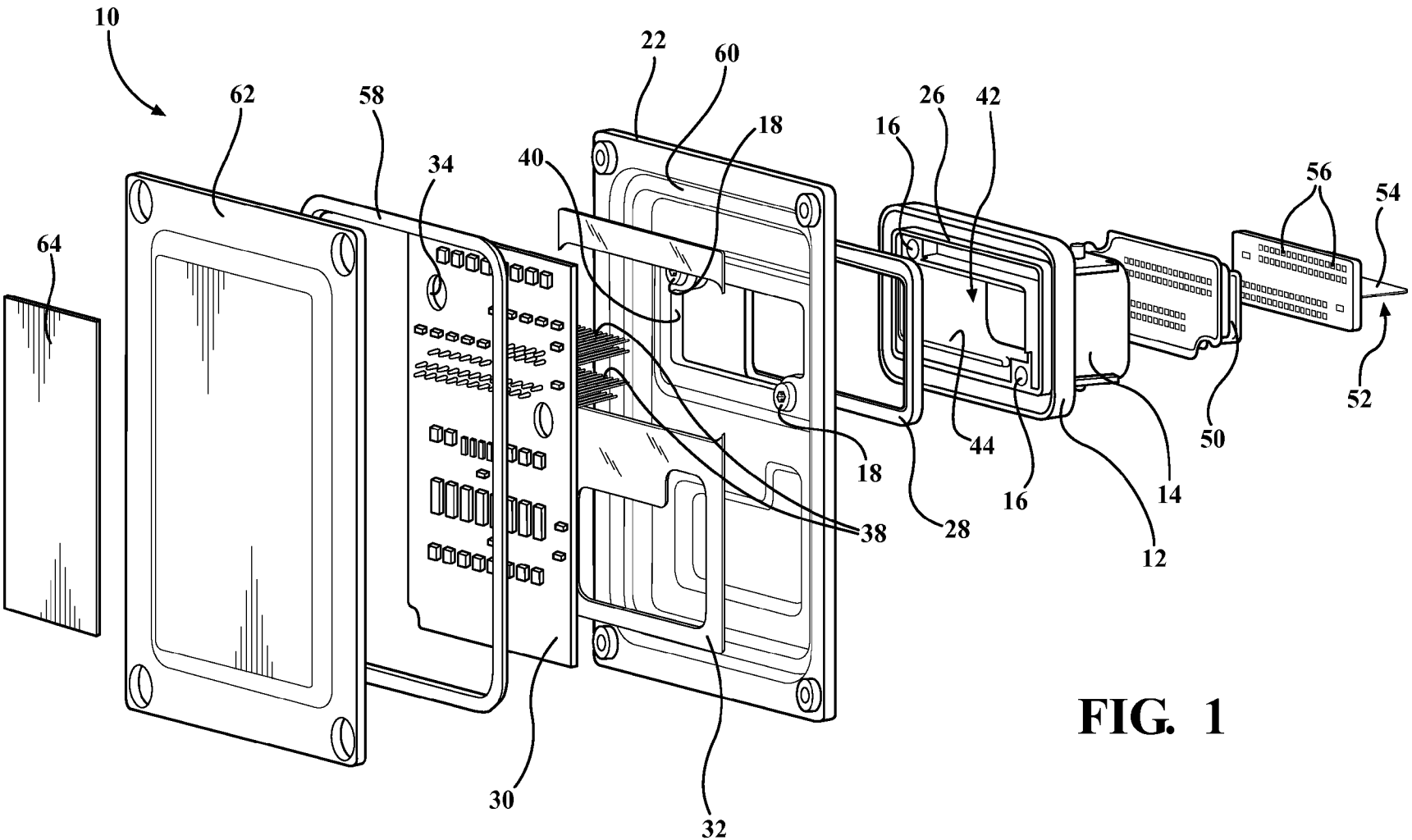
FIG. 1 is an exploded view of an electrical connection system, according to embodiments of the present invention.
Figure 2:
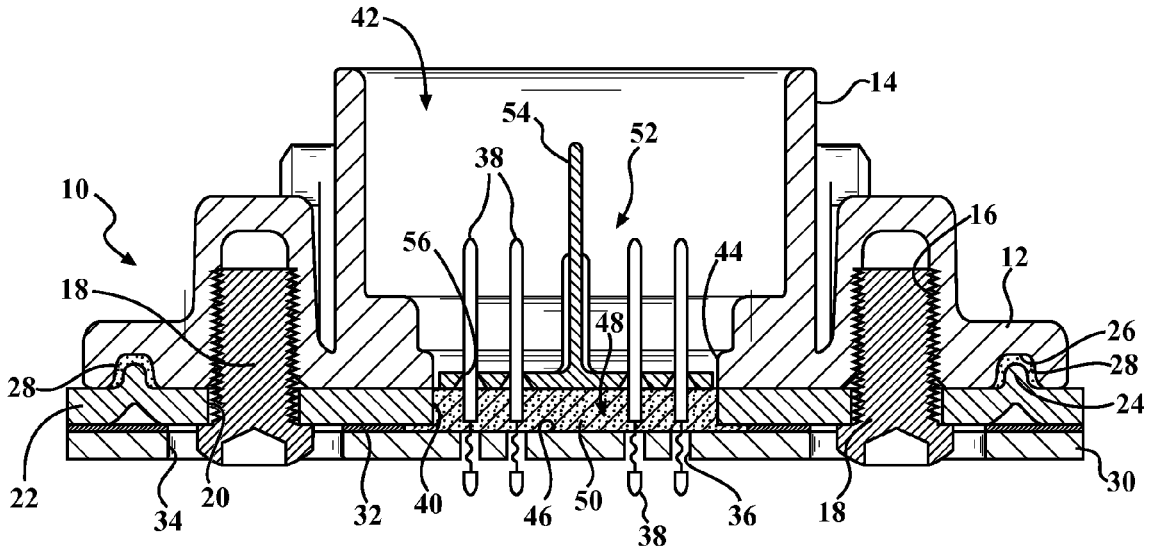
FIG. 2 is a sectional side view of an electrical connection system, according to embodiments of the present invention.

A connector having a connection system according to the present invention is shown in FIGS. 1-2 generally at 10. The connector 10 includes a housing 12 having a connector shroud 14. In one embodiment, there are apertures 16 formed as part of the housing 12 which are used for receiving corresponding fasteners, which in this embodiment are screws 18. The screws 18 also extend through apertures 20 which are formed as part of a heat sink 22, such that the screws 18 connect the heat sink 22 to the housing 12.

The heat sink 22 includes ribs 24 which partially extend into recesses 26 formed as part of the housing 12. Also located in the recesses 26 is a first sealant, or an outer sealant 28, which is used for preventing debris and moisture from entering the housing 12. In one embodiment, the heat sink 22 and the housing 12 are clamped together after the outer sealant 28 is placed in the recess 26, and the sealant 28 is cured, such that once the curing process is complete, the sealant 28 connects the housing 12 to the heat sink 22.

During assembly, the housing 12 may be attached to the heat sink 22 using the screws 18, as mentioned above, to hold the heat sink 22 and the housing 12 in place while the outer sealant 28 cures, or the heat sink 22 and housing 12 may be clamped together and held in place while the outer sealant 28 cures. Either approach may be used during assembly, and still be within the scope of the invention.

The connector 10 also has a printed circuit board (PCB) 30, which is attached to the heat sink 22 with a thermally conductive adhesive 32. The PCB 30 may also be attached to the heat sink 22 using a thermal interface material, or a pressure sensitive adhesive, and is not limited to use with the thermally conductive adhesive 32.

The PCB 30 also has a first set of apertures 34, which in this embodiment are outer apertures 34, through which the screws 18 extend, allowing the screws 18 to be exposed so a screwdriver or the like may be used to rotate the screws 18 during assembly. The PCB 30 also includes a second set of apertures 36, or inner apertures 36, and a pin 38 extends through each aperture 36. The pins 38 are press-fit into each of the inner apertures 36, and therefore there is no need for an additional adhesive to hold the pins 38 in place.

The heat sink 22 also includes a central aperture 40, and each of the pins 38 extends through the central aperture 40 and into a cavity, shown generally at 42, formed as part of the housing 12. The cavity 42 has multiple inner diameters, and one of the inner diameters 44 is substantially similar to the diameter of the central aperture 40. The central aperture 40 and the top surface 46 of the PCB 30 form part of a pocket, shown generally at 48. The pocket 48 also includes the areas between the PCB 30 and the heat sink 22 which are next to the thermally conductive adhesive 32. Disposed within the pocket 48 is a second sealant, or inner sealant 50, which substantially surrounds the pins 38, and holds the pins 38 in place once the sealant 50 is cured. The sealant 50 is also partially disposed between the heat sink 22 and the PCB 30, in an area adjacent the thermally conductive adhesive 32. The sealant 50 is a low viscosity fluid, and has a low enough viscosity that the sealant 50 only partially flows into the apertures 36 that the pins 38 are disposed in, but the sealant 50 does not flow through the apertures 36 enough to drain the pocket 48. Also disposed in the pocket 48 is a position assurance comb, shown generally at 52, having an anti-scoop rib 54.

After the sealant 50 is placed in the pocket 48, the comb 52 is placed in the pocket 48 such that the comb 52 is on top of the sealant 50, and is also held in place by the sealant 50 once the sealant 50 is cured. The comb 52 also has several apertures 56, and each pin 38 extends through a corresponding aperture 56. The anti-scoop rib 54 functions to correctly position a corresponding connector to align with the pins 38 of the connector 10, preventing pins 38 from scooping, or deflecting and permanently deforming. The sealant 50 also functions to absorb some of the insertion force applied to the pins 38 when the connector 10 is attached to a corresponding connector.

Referring to FIG. 1, there is also a third sealant, or lower sealant 58 disposed in a groove 60 formed as part of the heat sink 22. The third sealant 58 is used to connect a cover 62 to the heat sink 22. More specifically, the sealant 58 is placed into the groove 60, and then the cover 62 is correctly positioned relative to the heat sink 22, and then exposed to a curing process. Once the curing process is complete, the sealant 58 provides a connection between the heat sink 22 and the cover 62. There is also a label 64 attached to the cover 62, which may be used to identify the connector, by a serial number or the like.

Figure 3:
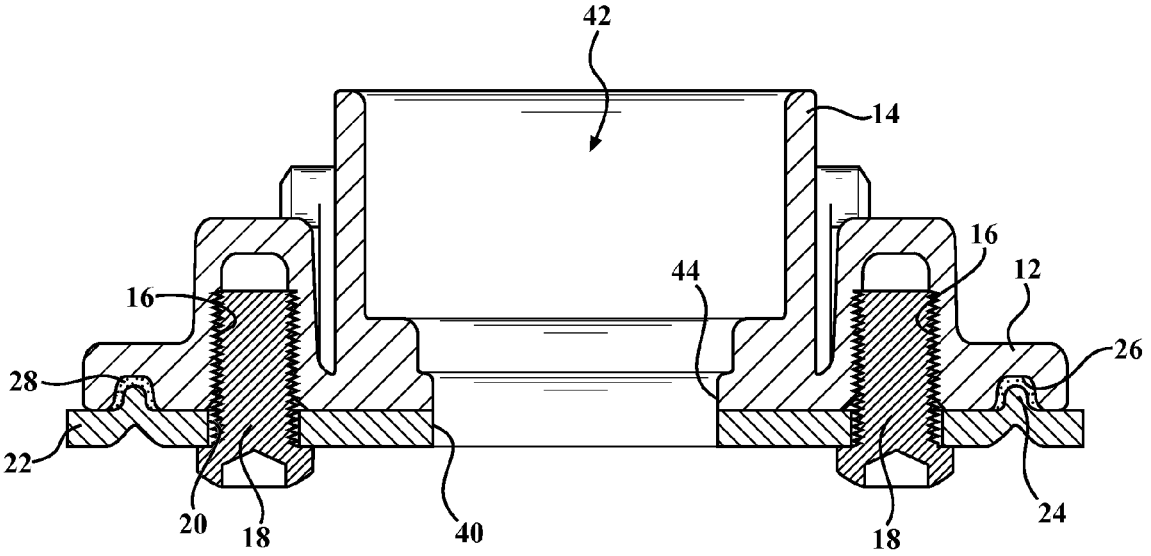
FIG. 3 is a sectional side view of a sub-assembly used as part of an electrical connection system, according to embodiments of the present invention.
Figure 4:
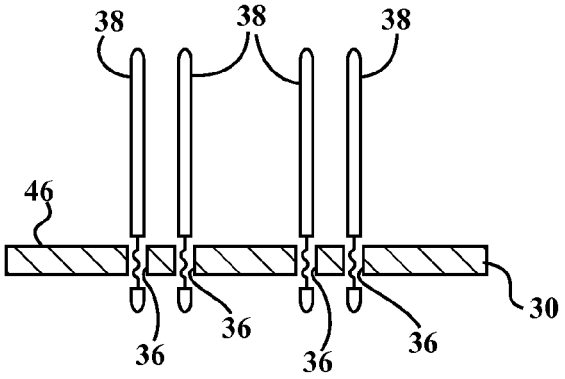
FIG. 4 is a sectional side view of a printed circuit board having single insertion press-fit pins, which is used as part of an electrical connection system, according to embodiments of the present invention.
Figure 5:
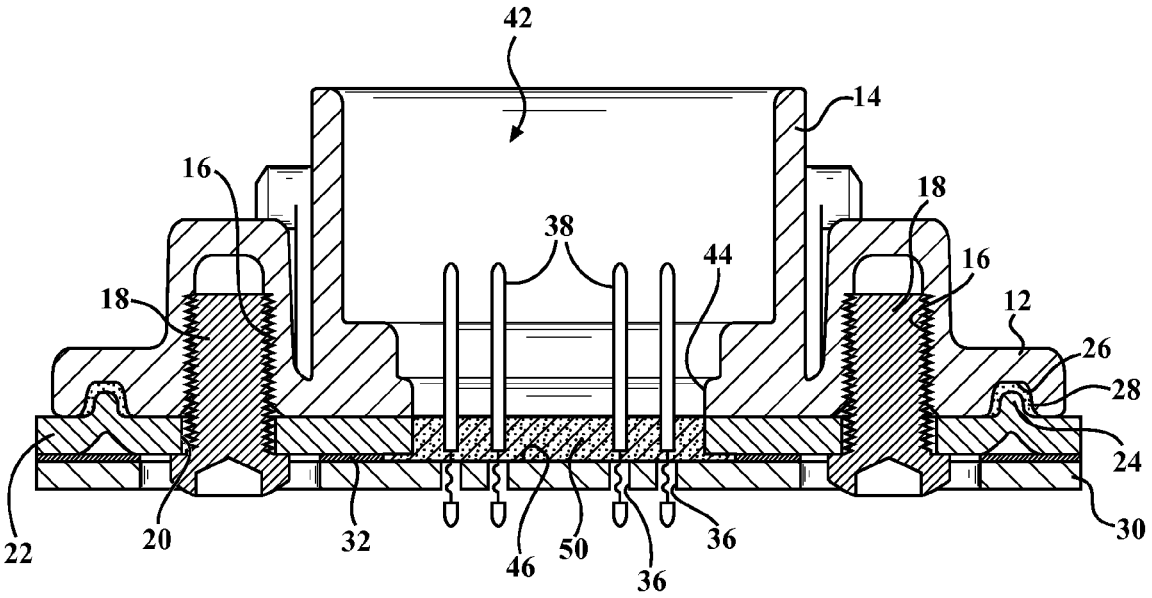
FIG. 5 is a sectional side view of an electrical connection system, prior to assembly of the position assurance comb, according to embodiments of the present invention.

A method of assembling a connector 10 according to the present invention is shown in FIGS. 3-5. In FIG. 3 the housing 12 is created having the connector shroud 14 and connected to the heat sink 22 using the screws 18 or a clamping process, as described above, and the sealant 28 is dispensed between them. The single insertion pins 38 are then press-fitted into the apertures 36 of the PCB 30, as shown in FIG. 4. The thermal conductive adhesive 32 is applied to the heat sink 22, and the PCB 30 is bonded to the heat sink 22 using the adhesive 32. This creates part of the pocket 48 for holding the low viscosity sealant 50, as shown in FIG. 5. As the sealant 50 enters the pocket 48, the apertures 36 allow for air to escape the pocket 48, preventing the build-up of internal air in the pocket 48 during the assembly process.

After the low viscosity sealant 50 is dispensed in the pocket 48, the position assurance comb 56 is placed over the pins 38 and onto the sealant 50, as shown in FIG. 2. Once the entire connector 10 is assembled as shown in FIG. 2, the connector 10 is exposed to an environment to cure the sealants 28,50,58, such that the outer sealant 28 is cured and connects the heat sink 22 and the housing 12, the lower sealant 58 is cured and connects the cover 62 to the heat sink 22, and the inner sealant 50 is cured and secures the location of the pins 38 in the pocket 48, and secures the position assurance comb 52 in the pocket 48 as well.

The anti-scoop rib 54 is able to be gripped during the assembly process, such as during a "pick and place" operation, where the rib 54 is gripped and used to assemble the comb 52 in the housing 12.

Figure 6:
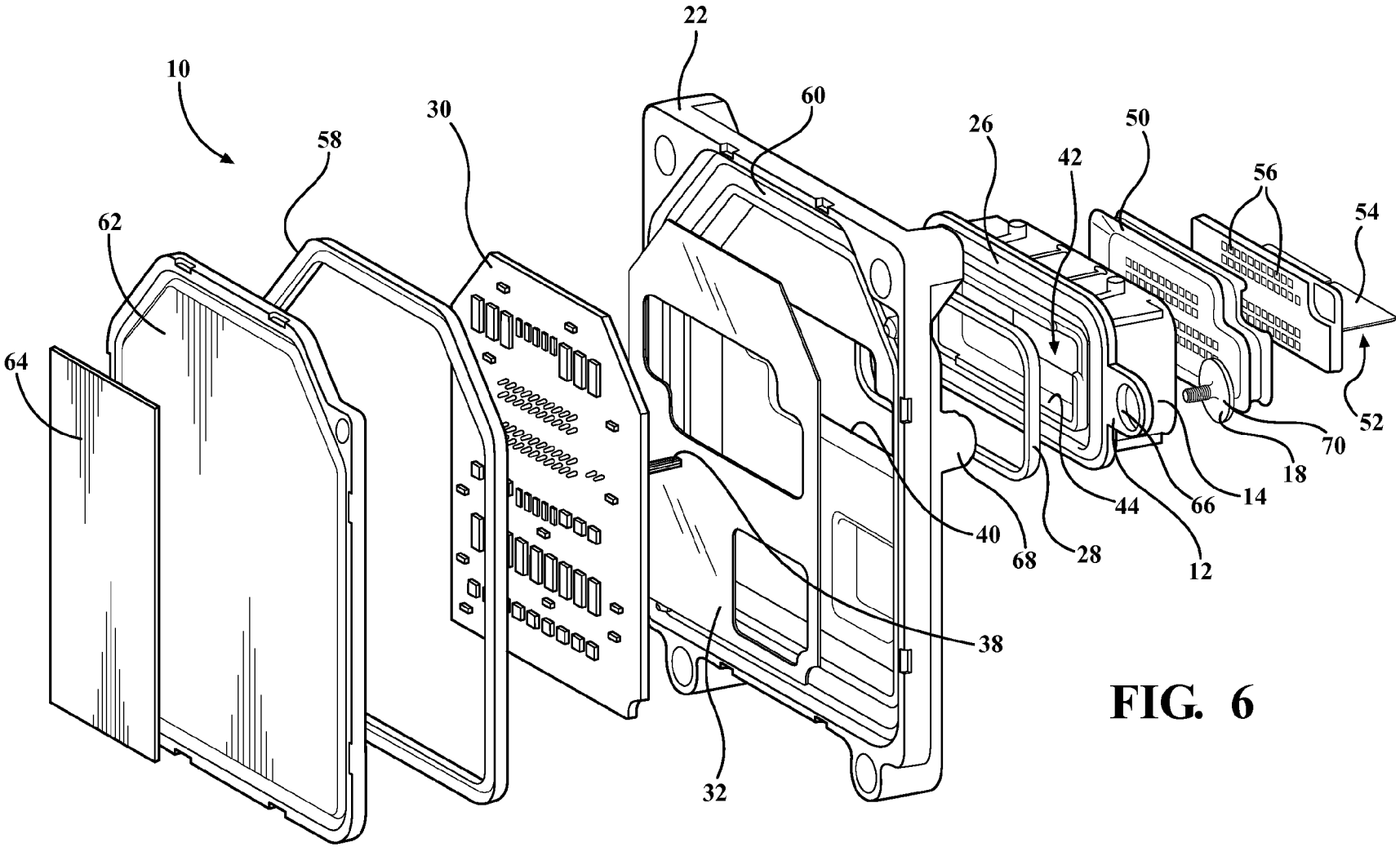
FIG. 6 is an exploded view of an alternate embodiment of an electrical connection system, according to embodiments of the present invention.

An alternate embodiment of the present invention is shown in FIG. 6, with like numbers referring to like elements. However, in this embodiment, the PCB 30, the thermally conductive adhesive 32, and the cover 62 are shaped differently. These components have a trapezoidal shape, as opposed to being substantially rectangular, as shown in FIG. 1. Additionally, instead of inserting the screws 18 through the apertures 34 in the PCB 30, and then through the apertures 20 of the heat sink 22 and into the apertures 16 of the housing 12, as shown in FIG. 2, the screws 18 in FIG. 6 are inserted through the apertures 66 (where the apertures 66 and screws 18 in FIG. 6 are formed differently from the apertures 16 and screws 18 shown in FIG. 1) first, then the screws 18 are inserted into apertures (not shown) formed as part of posts 68, where the posts 68 are formed as part of the heat sink 22. The screws 18 secure the heat sink 22 and the housing 12 together prior to the sealant 28 being cured.

As mentioned above, the apertures 66 are shaped differently from the apertures 16 shown in FIG. 1. The apertures 16 in FIG. 1 do not extend through the housing 12, and therefore, when the screw 18 is inserted into the apertures 16, the housing 12 is sealed from the outside environment. The apertures 66 in FIG. 6 extend through the housing 12, and the screws 18 in FIG. 6 have a large diameter head 70 which contacts the area surrounding the aperture 66, to prevent debris from entering the area between the housing 12 and the heat sink 22.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus comprising:

a housing;

a heat sink connected to the housing;

a circuit board having at least one aperture, the circuit board connected to the heat sink;

at least one pin mounted in the at least one aperture of the circuit board;

a pocket formed by the connection of the housing and the circuit board to the heat sink;

a central aperture formed as part of the heat sink, the central aperture forming part of the pocket such that the at least one pin extends through the central aperture when the circuit board is connected to the heat sink; and a sealant disposed in the pocket;

wherein the sealant is at least partially in contact with the circuit board and the heat sink, and at least partially surrounds the at least one pin, such that once the sealant is cured, the pins are secured in the pocket.

2. The apparatus of claim 1, wherein at least a portion of the sealant is located in the at least one aperture of the printed circuit board such that the sealant at least partially surrounds the at least one pin.

3. The apparatus of claim 1, further comprising:

a thermally conductive adhesive disposed between the circuit board and the heat sink, such that the thermally conductive adhesive connects the circuit board and the heat sink;

wherein a portion of the sealant located in the pocket is in contact with the thermally conductive adhesive, such that the thermally conductive adhesive at least partially contains the sealant in the pocket.

4. The apparatus of claim 1, further comprising:

at least one aperture formed as part of the housing;

at least one aperture formed as part of the heat sink; and at least one fastener;

wherein the at least one fastener is inserted through the at least one aperture formed as part of the heat sink and into the at least one aperture formed as part of the housing to connect the heat sink to the housing.

5. The apparatus of claim 1, further comprising:

a position assurance comb disposed in the pocket such that at least a portion of the sealant is disposed between the position assurance comb and the circuit board, and once the sealant is cured, the position assurance comb is secured in the pocket; and an anti-scoop rib formed as part of the position assurance comb;

wherein the anti-scoop rib provides proper alignment of the at least one pin during assembly.

6. The apparatus of claim 1, further comprising:

at least one recess formed as part of the housing;

at least one rib formed as part of the heat sink, the at least one rib at least partially disposed in the at least one recess when the heat sink is connected to the housing; and an outer sealant disposed in the at least one recess such that the outer sealant at least partially surrounds the at least one rib;

wherein the outer sealant is cured to connect the heat sink and the housing, and prevent debris from entering the housing.

7. The apparatus of claim 1, further comprising a shroud formed as part of the housing, at least a portion of the shroud in alignment with the pocket.

8. The apparatus of claim 1, the circuit board further comprising a printed circuit board.

9. An electrical connector, comprising:

a housing having a cavity;

a shroud integrally formed as part of the housing;

a heat sink connected to the housing;

a printed circuit board connected to the heat sink, such that the heat sink is between the printed circuit board and the housing;

at least one aperture formed as part of the printed circuit board;

at least one pin located in the aperture formed as part of the printed circuit board such that the at least one pin extends into the cavity of the housing;

a pocket formed by a central aperture in the heat sink, and at least a portion of the printed circuit board;

a central aperture formed as part of the heat sink, the central aperture forming part of the pocket such that the at least one in extends through the central aperture when the circuit board is connected to the heat sink; and a sealant located in the pocket such that at least part of the sealant contacts the printed circuit board and at least partially surrounds the at least one pin;

wherein the sealant is cured to at least partially seal the area between the heat sink and the printed circuit board, and secure the at least one pin in the pocket.

10. The electrical connector of claim 9, further comprising:

at least one aperture formed as part of the housing;

at least one aperture formed as part of the heat sink, such that the at least one aperture formed as part of the heat sink is substantially aligned with the at least one aperture formed as part of the housing; and at least one fastener;

wherein the at least one fastener is inserted through the at least one aperture formed as part of the heat sink and into the at least one aperture formed as part of the housing to connect the heat sink to the housing.

11. The electrical connector of claim 9, further comprising:

a position assurance comb disposed in the pocket such that at least a portion of the sealant is disposed between the position assurance comb and the printed circuit board, and once the sealant is cured, the position assurance comb is secured in the pocket; and an anti-scoop rib formed as part of the position assurance comb;

wherein the anti-scoop rib provides proper alignment of the at least one pin during the connection of the at least one pin to another connector.

12. The electrical connector of claim 9, further comprising:

a thermally conductive adhesive disposed between the printed circuit board and the heat sink, such that the thermally conductive adhesive connects the printed circuit board and the heat sink;

wherein a portion of the sealant located in the pocket is in contact with the thermally conductive adhesive, such that the thermally conductive adhesive at least partially contains the sealant in the pocket.

13. The electrical connector of claim 9, wherein at least a portion of the sealant is located in the at least one aperture formed as part of the printed circuit board such that the sealant at least partially surrounds the at least one pin.

14. The electrical connector of claim 9, further comprising:

at least one recess formed as part of the housing;

at least one rib formed as part of the heat sink, the at least one rib at least partially disposed in the at least one recess when the heat sink is connected to the housing; and an outer sealant disposed in the at least one recess such that the outer sealant at least partially surrounds the at least one rib;

wherein the outer sealant is cured to connect the heat sink and the housing, and prevent debris from entering the housing.

15. The electrical connector of claim 9, wherein the pin is press-fit into the at least one aperture formed as part of the printed circuit board.

16. A method of assembling a connector, comprising the steps of:

providing a housing;

providing a heat sink having a central aperture;

providing a printed circuit board;

providing at least one pin; and providing a position assurance comb;

connecting the at least one pin to the printed circuit board;

connecting the heat sink to the housing;

connecting the printed circuit board to the heat sink such that a pocket is formed by the central aperture of the heat sink and a portion of the printed circuit board, and the at least one pin extends through the central aperture into the housing;

dispensing a sealant into the pocket to seal the area of the printed circuit board around the at least one pin;

positioning the position assurance comb in the housing such that the position assurance comb contacts the sealant, and the at least one pin extends through the position assurance comb;

curing the sealant such that the sealant connects the heat sink to the housing, secures the position of the at least one pin in the pocket, and secures the position assurance comb in the pocket.

17. The method of assembling a connector of claim 16, further comprising the steps of:

providing a thermally conductive adhesive;

connecting the printed circuit board to the heat sink using the thermally conductive adhesive, such that the connection between the printed circuit board and the heat sink using the thermally conductive adhesive forms at least part of the pocket.

18. The method of assembling a connected of claim 16, further comprising the steps of:

providing a plurality of apertures formed as part of the housing;

providing a plurality of apertures formed as part of the heat sink; and providing a plurality of fasteners;

inserting each of the plurality of fasteners through a corresponding one of the plurality of plurality of apertures formed as part of the housing and a corresponding one of the plurality of apertures formed as part of the heat sink, connecting the heat sink to the housing.

19. The method of assembling a connected of claim 16, further comprising the steps of providing an anti-scoop rib formed as part of the position assurance comb, such that the anti-scoop rib provides proper alignment of the at least one pin during assembly.

20. The method of assembling a connected of claim 16, further comprising the steps of:

providing at least one recess formed as part of the housing;

providing at least one rib formed as part of the heat sink; and providing an outer sealant;

depositing the outer sealant in the at least one recess formed as part of the housing such that the outer sealant at least partially surrounds the at least one rib formed as part of the heat sink;

curing the outer sealant such that the outer sealant connects the heat sink to the housing, and prevents debris from entering the area between the heat sink and the housing.

21. The method of assembling a connected of claim 16, further comprising the steps of:

providing at least one aperture formed as part of the printed circuit board;

press-fitting the at least one pin into the at least one aperture formed as part of the printed circuit board, a second flux density plot, indicating the magnetic flux density measured from the second section; and a second run out plot, indicating the run out measured from the second section;

wherein the first flux density plot, the second flux density plot, first run out plot, and the second run out plot are plotted together on the plot.

* * * * *